US010895030B1

(12) United States Patent
Baker et al.

(10) Patent No.: US 10,895,030 B1
(45) Date of Patent: Jan. 19, 2021

(54) PALLETLESS SEWING METHODS AND SYSTEMS

(71) Applicant: SoftWear Automation Inc., Cumming, GA (US)

(72) Inventors: Michael Baker, Acworth, GA (US); Wael Saab, Atlanta, GA (US)

(73) Assignee: SoftWear Automation, Inc., Cumming, GA (US)

( * ) Notice: Subject to any disclaimer, the term of this patent is extended or adjusted under 35 U.S.C. 154(b) by 0 days.

(21) Appl. No.: 16/918,875

(22) Filed: Jul. 1, 2020

(51) Int. Cl.
*D05B 39/00* (2006.01)
*D05B 53/00* (2006.01)
*D05B 69/30* (2006.01)

(52) U.S. Cl.
CPC ..... *D05B 39/00* (2013.01); *D05B 53/00* (2013.01); *D05B 69/30* (2013.01)

(58) Field of Classification Search
CPC ..... D05B 39/00; D05B 53/00; D05B 69/00; D05B 21/00; D05B 35/04; D05B 35/02; D05B 3/00; D05B 3/24; D05B 3/10; D05B 27/00; D05B 27/10–16; D05B 29/00; D05B 29/10; D05B 31/00; B43L 13/20
See application file for complete search history.

(56) References Cited

U.S. PATENT DOCUMENTS 3,828,703 A * 8/1974 Sugland ..... D05B 39/00 112/470.09
4,114,544 A * 9/1978 Miyachi ..... D05B 35/068 112/104
4,493,276 A * 1/1985 Sadeh ..... D05B 93/00 112/470.07
4,813,364 A * 3/1989 Boser ..... D05B 27/12 112/153
4,928,609 A * 5/1990 Kawasaki ..... D05B 39/00 112/148
5,443,025 A * 8/1995 Webb ..... D05B 39/00 112/102.5
5,588,384 A * 12/1996 Miyachi ..... D05B 35/068 112/470.34
5,666,895 A * 9/1997 Gehres ..... D05B 3/20 112/114
5,865,137 A * 2/1999 Frye ..... D05B 39/00 112/470.14
2011/0315059 A1* 12/2011 Lee ..... D05C 9/04 112/103

* cited by examiner

*Primary Examiner* — Ismael Izaguirre
(74) *Attorney, Agent, or Firm* — Thomas | Horstemeyer, LLP

(57) ABSTRACT

Various examples are provided related to transporting and sewing material in, e.g., automation of sewing robots. Multiple pieces of layered materials can be transported on a flat planar surface while maintaining the material layer's position and orientation relative to one another during a sewing procedure of these materials along any arbitrary seam shape. In one example, among others, a method includes positioning a second piece of material on a first piece of material located on a sewing plane, positioning a material holding apparatus over the pieces of material to secure position and orientation between the pieces of material, locating the pieces of material with respect to an automated sewing machine by repositioning the material holding apparatus, and sewing the second piece of material to the first piece of material. The methods can eliminate the need of custom-made templates for sewing arbitrarily shaped seams with an automated sewing machine.

20 Claims, 7 Drawing Sheets

PALLETLESS SEWING METHODS AND SYSTEMS

CROSS REFERENCE TO RELATED APPLICATIONS

This application is related to U.S. application entitled "ADAPTIVE APPARATUS FOR TRANSPORTING AND SEWING MATERIAL ALONG ARBITRARY SEAM SHAPES" having Ser. No. 16/918,803 filed Jul. 1, 2020, which is hereby incorporated by reference in its entirety.

BACKGROUND

Often in the production of sewn products, stitches must be sewn with a high degree of accuracy onto one or more flat pieces of material. These stitches may be decorative, structural, or both, and may not follow features of the materials themselves. Because of the above mentioned nature of these seams, human operators are not well suited to the task, and instead a pattern sewing machine is often used.

Pattern sewing machines utilize custom made templates to clamp onto layers of materials prior to initiating the sewing procedure. These templates are then loaded onto a pattern sewing machine. The pattern sewing machine will move these templates with clamped layers of materials to the sewing needle. The pattern sewing machine will then follow a predefined path and sew seam lines within the manufactured open shapes of the template (at high speeds). Often each product will require several of these templates for each size, style, and manufacturing step, reducing manufacturing flexibility and increasing tooling cost.

Historically these templates, often referred to as pallets, have a limited number of seam paths that they can be used with, and no or very little active reconfiguration during sewing. Alternatively, palletless pattern sewing involves the use of apparatus and control schemes that allow for a very large or near-infinite number of seam paths to be sewn with the same material holding and manipulation hardware.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology.

BRIEF DESCRIPTION OF THE DRAWINGS

The accompanying drawings illustrate various examples of systems, methods, and embodiments of various other aspects of the disclosure. Any person with ordinary skills in the art will appreciate that the illustrated element boundaries (e.g., boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles. Moreover, in the drawings, like reference numerals designate corresponding parts throughout the several views.

DETAILED DESCRIPTION

Figure 1:
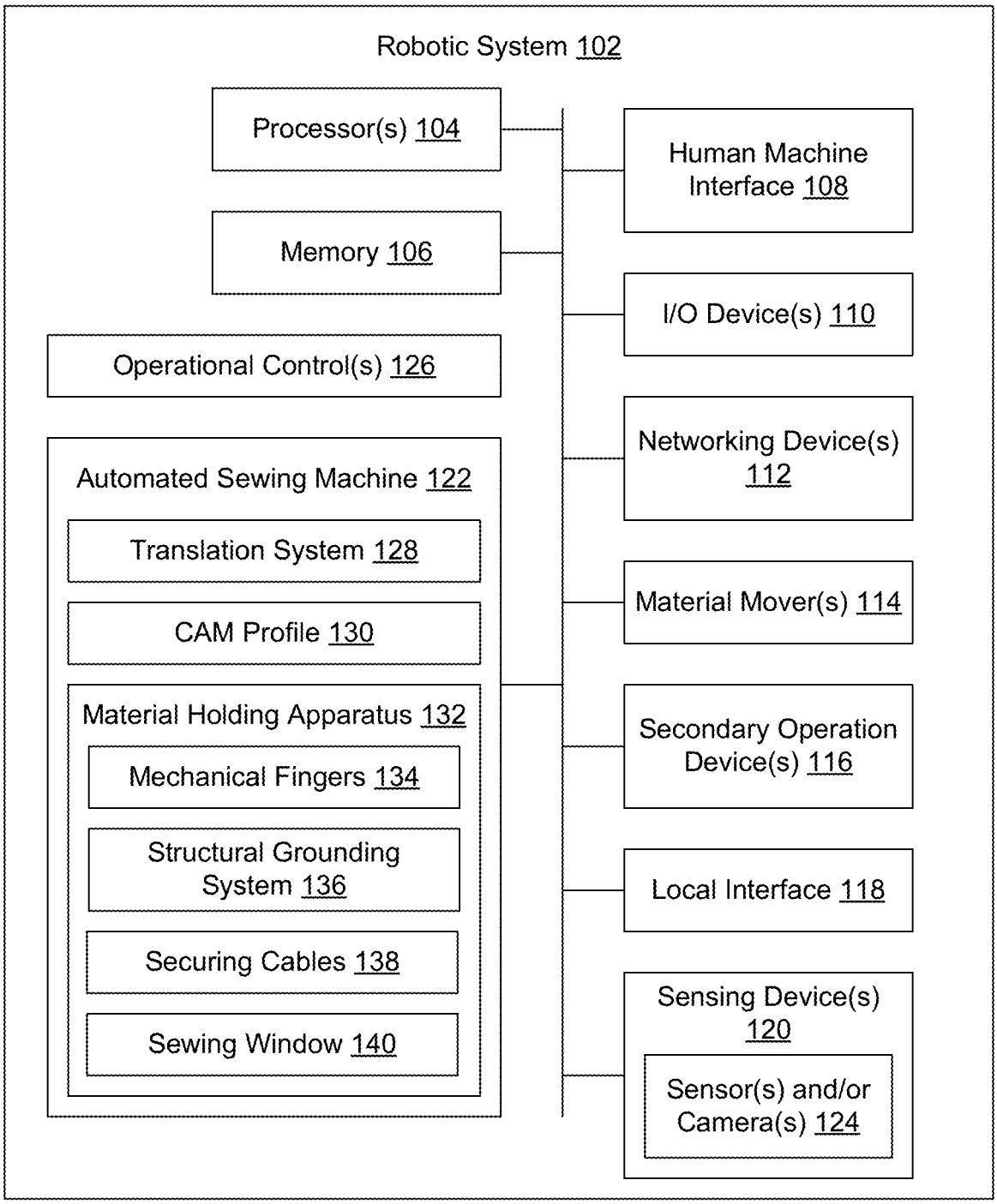
FIG. 1 illustrates an example of a robotic system, according to various embodiments of the present disclosure.

Disclosed herein are various examples related to securing the orientation and position of layered materials for sewing in, e.g., the automated production of sewn products. The present disclosure is generally related to a method of securing the orientation and position of layered materials in order to be sewn with an automated sewing machine. For example, a universal method can enable sewing multiple material layers of various designs and sizes since it can adapt to arbitrary seam shapes. It can clamp down onto layered materials and prevents them from puckering, slipping or shifting their relative position and orientation during a sewing operation. Reference will now be made in detail to the description of the embodiments as illustrated in the drawings, wherein like reference numbers indicate like parts throughout the several views.

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present disclosure, the preferred systems and methods are now described.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Referring to FIG. 1, shown is an example of a system that can be used for material manipulation and sewing. As illustrated in the example of FIG. 1, the system can comprise a robotic system 102 (e.g., a sewing robot), which can include a processor 104, memory 106, an interface such as, e.g., a human machine interface (HMI) 108, I/O device(s) 110, networking device(s) 112, material mover(s) 114, secondary operation device(s) 116, a local interface 118, sensing device(s) 120, and an automated sewing machine 122. The sensing device(s) 120 can comprise one or more sensor and/or camera 124. The robotic system 102 can also include operational control(s) 126, which can be executed by the robotic system 102 to implement manipulation and/or processing of materials. The automated sewing machine 122 can comprise, e.g., a translation system 128, a cam profile 130, material holding apparatus 132, mechanical fingers 134 and a structural grounding system 136.

The processor 104 can be configured to decode and execute any instructions received from one or more other electronic devices or servers. The processor can include one or more general-purpose processors (e.g., INTEL® or Advanced Micro Devices® (AMD) microprocessors) and/or one or more special purpose processors (e.g., digital signal processors or Xilinx® System on Chip (SOC) field programmable gate array (FPGA) processor). The processor 104 may be configured to execute one or more computer-readable program instructions, such as program instructions to carry out any of the functions described in this description.

The Memory 106 can include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions. The Memory 106 can comprise one or more modules (e.g., operational control(s) 126) that can be implemented as a program executable by processor(s) 104.

The interface(s) or HMI 108 can accept inputs from users, provide outputs to the users or may perform both the actions. In one case, a user can interact with the interface(s) using one or more user-interactive objects and devices. The user-interactive objects and devices may comprise user input buttons, switches, knobs, levers, keys, trackballs, touchpads, cameras, microphones, motion sensors, heat sensors, inertial sensors, touch sensors, visual indications (e.g., indicator lights or meters), audio indications (e.g., bells, buzzers, etc.) or a combination of the above. Further, the interface(s) can either be implemented as a command line interface (CLI), a graphical user interface (GUI), a voice interface, or a web-based user-interface, at element 108. The interface(s) can also include combinations of physical and/or electronic interfaces, which can be designed based upon the environmental setting or application.

The input/output devices or I/O devices 110 of the robotic system 102 can comprise components used to facilitate connections of the processor 104 to other devices such as, e.g., material mover(s) 114, secondary operation device(s) 116, sensing device(s) 120 and/or the automated sewing machine 122 and can comprise one or more serial, parallel, small system interface (SCSI), universal serial bus (USB), IEEE 1394 (i.e. Firewire™) connection elements or other appropriate connection elements.

The networking device(s) 112 of the robotic system 102 can comprise the various components used to transmit and/or receive data over a network. The networking device(s) 112 can include a device that can communicate both inputs and outputs, for instance, a modulator/demodulator (i.e. modem), a radio frequency (RF) or infrared (IR) transceiver, a telephonic interface, a bridge, a router, as well as a network card, etc.

The material mover(s) 114 of the robotic system 102 can facilitate material manipulation between operations. The material mover(s) 114 can move, stack, orient or position the materials prior to the next operation. In some embodiments, the material mover(s) 114 may transport materials into a predetermined alignment prior to a sewing or other operation.

In some embodiments, the material mover(s) 114 can comprise a manipulator capable of spatial motions and one or more material handling components. These material handling components, depending on the material being handled, can utilize various gripping technologies such as, e.g., air flow, vacuum, mechanical gripping, such as a clamp, pinching, pins, or needles, electro-adhesion, adhesion, electrostatic forces, freezing, brush, or hook and loop, etc. In various embodiments, the material mover(s) 114 can comprise end effector(s) which can be manipulated through one or more manipulator(s) such as, e.g., industrial robot(s) or other manipulator or appropriate manipulation assembly. Industrial robots include, e.g., articulated robots, selective compliance assembly robots (SCARA), delta robots, and cartesian coordinate robots (e.g., gantry robots or x-y-z robots). Industrial robots can be programmed to carry out repetitive actions with a high degree of accuracy or can exhibit more flexibility by utilizing, e.g., machine vision and machine learning. For example, a material mover can be moved to engage with the material and manipulate its position and/or orientation for processing by the robotic system 102. When the desired processing of the material is complete, movement of the material mover 114 can transport the material out of the work area. This automated motion can be very beneficial in many repetitive processes. The secondary operation device(s) 116 can include stacking device(s), folding device(s), label manipulation device(s), and/or other device(s) that assist with the preparation, making and/or finishing of the sewn product.

The local interface 118 of the robotic system 102 can be, for example, but not limited to, one or more buses or other wired or wireless connections, as is known in the art. The local interface 118 can have additional elements, which are omitted for simplicity, such as controllers, buffers (caches), drivers, repeaters, and receivers, to enable communications. Further, the local interface 118 can include address, control, and/or data connections to enable appropriate communications among the components, at element 122.

The sensing device(s) 120 of the robotic system 102 can facilitate detecting the movement of the product material(s) and inspecting the product material(s) for defects and/or discrepancies before, during or after a sewing and cutting operation or other process operation. Further, the sensing device(s) 120 can facilitate detecting markings on the product before cutting or sewing the material. A sensing device 120 can comprise, but is not limited to, one or more sensor and/or camera 124 such as, e.g., an RGB camera, an RGB-D camera, a near infrared (NIR) camera, stereoscopic camera, photometric stereo camera (single camera with multiple illumination options), time of flight camera, Internet protocol (IP) camera, light-field camera, monorail camera, multiplane camera, rapatronic camera, stereo camera, still camera, thermal imaging camera, acoustic camera, rangefinder camera, etc., at element 120. The RGB-D camera is a digital camera that can provide color (RGB) and depth information for pixels in an image. The sensing device(s) 120 can also include one or more motion sensor(s), temperature sensor(s), humidity sensor(s), microphone(s), ultrasound device(s), radar or lidar device(s), RF receiver(s) and/or other environmental or electronic sensor(s).

An automated sewing machine 122 is a sewing system that can include a computerized sewing machine, a material securing assembly to secure one or more layers of material, and computer-controlled actuators that can move the material securing assembly relative to the sewing machine to facilitate the sewing of the secured material(s). The translation system 128 can include elements responsible for the relative motion between the material securing assembly and the sewing machine of the automated sewing machine 122. In one embodiment, this motion could be achieved with an XYZ cartesian motion system (e.g., cartesian coordinate robots, gantry robots or x-y-z robots), where the XY motion is planar and on a sewing plane (or worksurface) 209, and the Z motion lifts or drops the material securing assembly onto the material(s). In another embodiment, the translation system 128 can use a polar motion system. In yet another embodiment, the translation system 128 can be any of a number of styles of industrial robot. In some embodiments, the automated sewing machine 122 can comprise securing cables 138. In various embodiments, the automated sewing machine 122 can comprise a sewing window 140. The operational control(s) 126 can also comprise an alignment module and/or pattern database, which can be used in the sewing process.

The material securing assembly of the automated sewing machine 122 can include a material holding apparatus 132 that can adapt during operation of the automated sewing machine 122. The material holding apparatus 132 is capable of changing its contact points on the material(s) during the sewing process to allow the sewing machine access to most or all of the surface of the material.

As shown in FIG. 1, the robotic system 102 includes operational control(s) 126 which can control the robotic system 102, as will be discussed. The operational control(s) 126 can include one or more process modules that can be executed in order to control operation of various components of the robotic system 102 such as the automated sewing machine 122.

Functioning of the automated sewing machine 122 will now be discussed with reference to FIGS. 2A and 2B. One skilled in the art will appreciate that, for this and other processes and methods disclosed herein, the functions performed in the processes and methods may be implemented in differing order. Furthermore, the outlined operations are provided as examples, and some of the operations may be optional, combined into fewer operations, or expanded into additional operations without detracting from the essence of the disclosed embodiments.

Figure 2A:
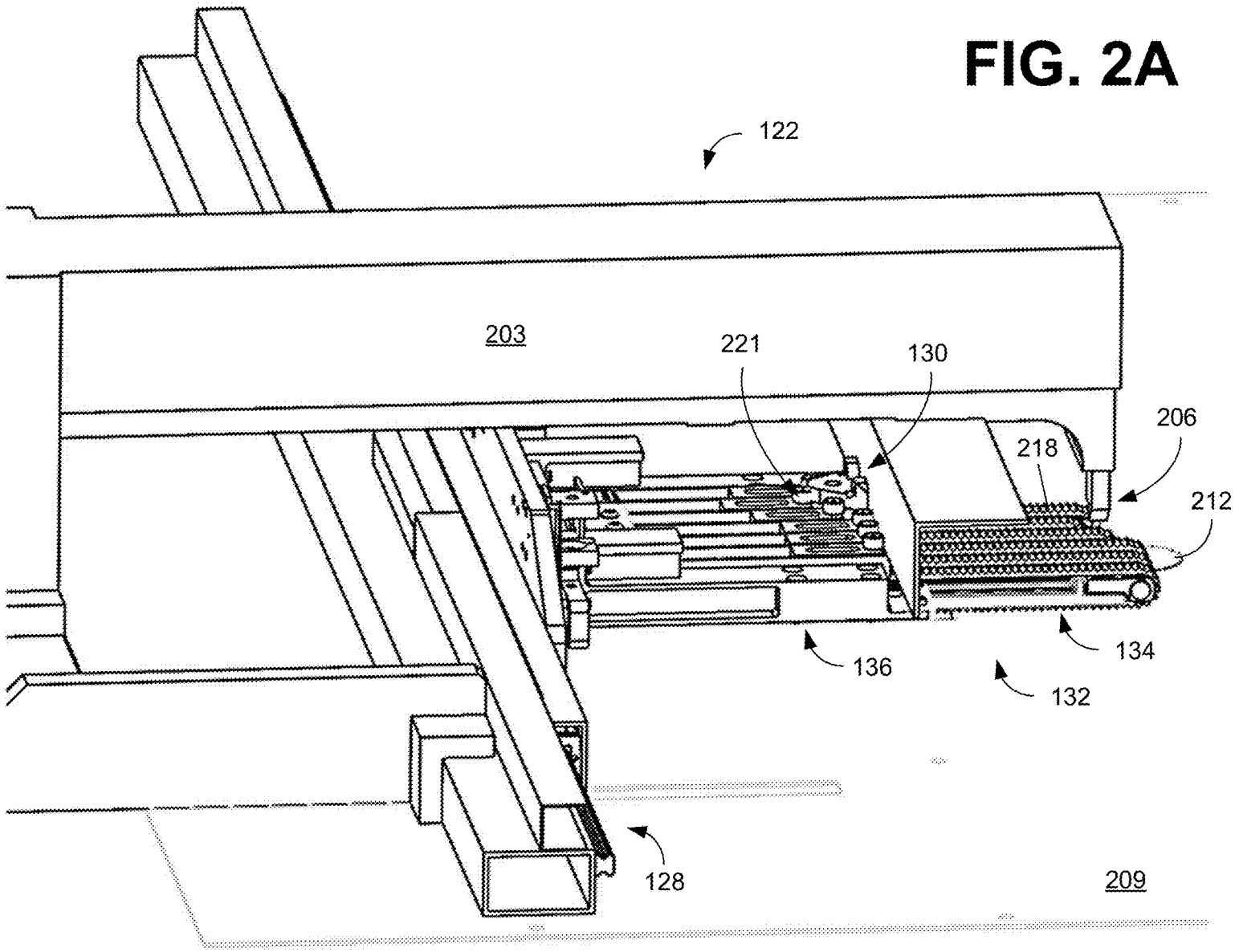
FIGS. 2A and 2B illustrate examples of a material holding apparatus comprising a translation system and material holding apparatus, according to various embodiments of the present disclosure.

FIG. 2A displays an embodiment of the automated sewing machine 122, comprising a sewing machine 203 with a sewing needle 206 (e.g., a computerized JUKI® sewing machine), the translation system 128, and an example of the material holding apparatus 132. The sewing machine 203 forms stitches in the material(s) 212 using the sewing needle 206. In another embodiment, the sewing machine 203 can be replaced with an ultrasonic device that ultrasonically welds the material(s) 212. In yet another embodiment, the sewing machine 203 can be replaced with a device that performs a different operation on the material(s) 212 such as applying glue, forming buttonholes, adding buttons, printing, cutting, or adding decoration.

The translation system 128 moves the material holding apparatus 132 with respect to the sewing needle 206. In the present embodiment, the translation system 128 can comprise a set of computer-controlled actuators that can move the material holding apparatus 132 in a Cartesian manner, with a vertical Z axis that acts perpendicular to the sewing plane 209 and X and Y axis that act along the sewing plane 209. In another embodiment, the translation system 128 can be a system of actuators that moves the material holding apparatus 132 in a polar manner. In yet another embodiment, the translation system 128 could be an industrial robot, such as a 6-axis robot or a SCARA robot, that is able to move the material holding apparatus 132 along many axes of motion.

The material holding apparatus 132 can comprise, as one possible embodiment, a linear finger clamp device, which can comprises of a single array or multiple arrays of mechanical fingers 134 where the fingers of each array are aligned next to each other and are able to translate along their longitudinal axis independently from each other and the translation system 128. Belts 218 wrap around each mechanical finger 134. The lower surface of the belts 218 contact the material(s) and transfer the motion of the translation system 128 to the material(s) 212. The belts 218 can be affixed in such a way as to impart no or limited force on the material(s) 212 when the mechanical fingers 134 are translated with respect the sewing needle 206, rolling over the material(s) 212. The belts 218 can also directly move the material(s) 212 when the translation system 128 moves, irrespective of the relative motion of the mechanical fingers 134. Mechanical fingers 134 attached to the structural grounding system 136 can clamp onto multiple layers of material through the belts 218 to rotate about the finger, which can adapt to different styles, sizes, and sew arbitrarily shaped seam lines at high speeds.

A cam profile 130 can be a body fixed in space, e.g., with respect to the sewing machine 203, allowing followers 221 of the mechanical fingers 134 to move on the cam profile 130 to produce finger displacement. Tensioning devices (e.g., springs) coupled to the mechanical fingers can press the followers against the surface of the cam profile. The cam profile 130 can be shaped to prevent the mechanical fingers 134 from entering a sewing window around the sewing needle 206. The shape of the cam profile 130 can be designed to produce a desired motion of the followers and thus a desired exclusion zone of the mechanical fingers 134. The automated sewing machine 122 can thus sew an arbitrary shaped seam across much of the surface of the material(s) 212 without the material holding apparatus 132 interfering with the sewing mechanisms. In other implementations, individual position control (e.g., pneumatic piston or cylinder, linear motor, etc.) can be used to reposition individual material fingers 134. For example, the structural grounding system 136 can comprise a piston or cylinder system, or linear motor system, attached to the translation system 128 in order to provide the linear translations for each of the individual mechanical fingers 134. Each mechanical finger 134 can be controlled individually by a corresponding pneumatic piston or cylinder.

While material(s) 212 can be sewn on the sewing plane 209 utilizing a single array of mechanical fingers 134 of the material holding apparatus 132 as illustrated in FIG. 2A, multiple arrays of mechanical fingers 134 can also be used to hold the material(s) during sewing. For example, the material holding apparatus 132 can comprise two arrays of mechanical fingers 134 positioned, e.g., on opposite sides of the sewing needle 206 to facilitate sewing of the material pieces 212 as illustrated in FIG. 2B. The transportation system 128 can be configured to independently position the arrays of mechanical fingers 134 to contact the material(s) 212. The mechanical fingers 134 of each array can linearly translate away from the sewing needle 206 to provide the needed clearance using a corresponding cam profile 130. In other implementations, individual position control (e.g., pneumatic piston or cylinder, linear motor, etc.) can be used to reposition individual material fingers 134. The use of multiple arrays of mechanical fingers 134 can assist in the handling of larger pieces of material 212. By contacting the material 212 on two or more sides of the sewing needle 206, the material can be securely held in position during sewing.

Figure 2B:
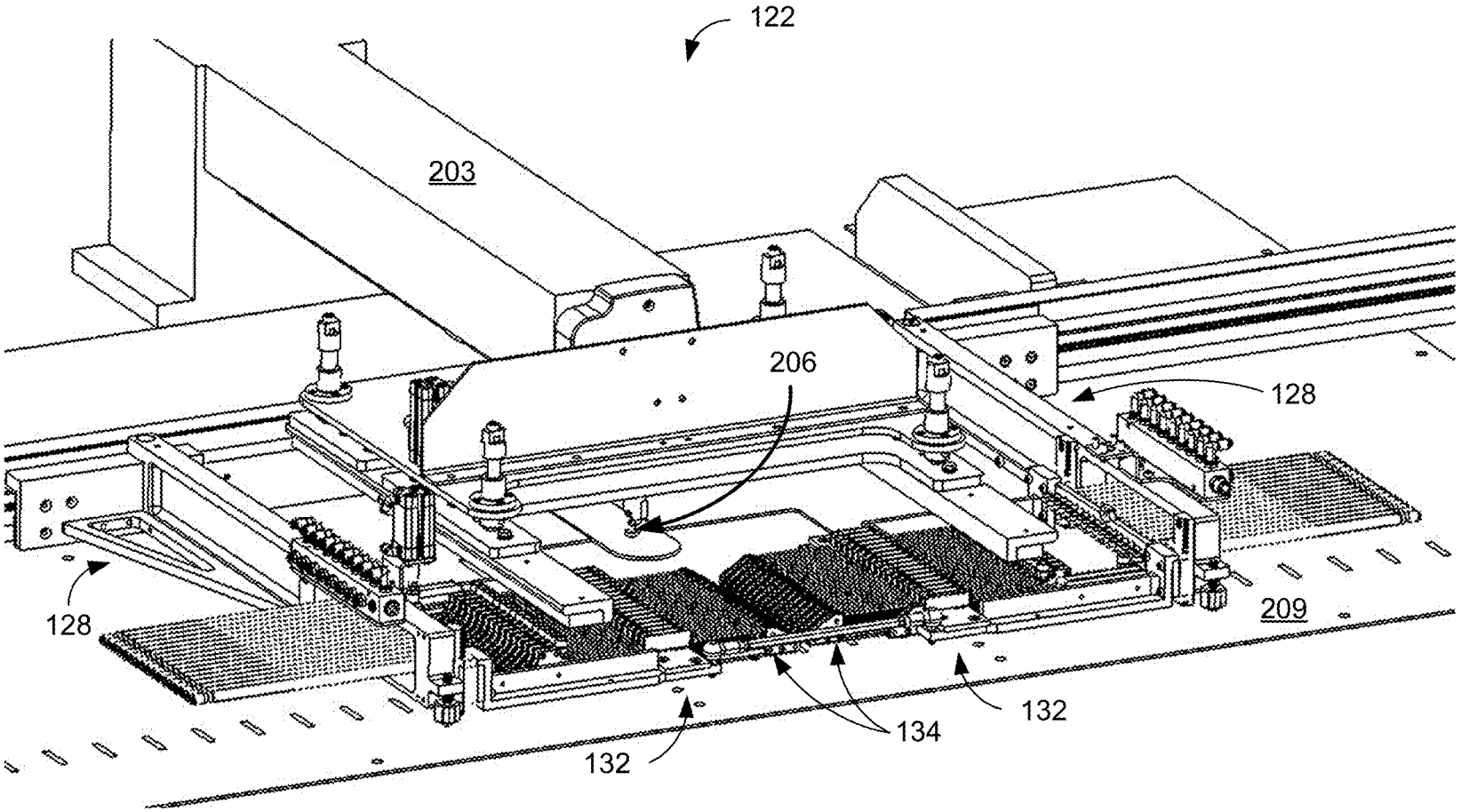

As shown in FIG. 2B, the material holding apparatus 132 comprising the two arrays of mechanical fingers 134 is extended beyond the sewing needle 206 at the sewing head of the sewing machine 203. The translation system 128 allows the material holding apparatus 132 to move in an XY motion. The linear array of mechanical fingers 134 acts as a means of transporting layers of material on a planar surface of the sewing plane 209 without altering their relative position and orientation. With the material holding apparatus 132 positioned with the two arrays of mechanical fingers 134 on the material, the translation system 128 can move the material under the sewing needle 206 via the material holding apparatus 132. As the arrays of mechanical fingers 134 are advanced toward the sewing needle 206, individual mechanical fingers 134 on opposite sides of the sewing needle 206 are retracted to provide clearance around the sewing needle 206 as it sews the material. For example, each array of material fingers 134 can use a cam profile 130 to retract material fingers 134 in the vicinity of the sewing needle 206. In other implementations, individual position control (e.g., pneumatic piston or cylinder, linear motor, etc.) can be used to reposition individual material fingers 134.

Figure 3A:
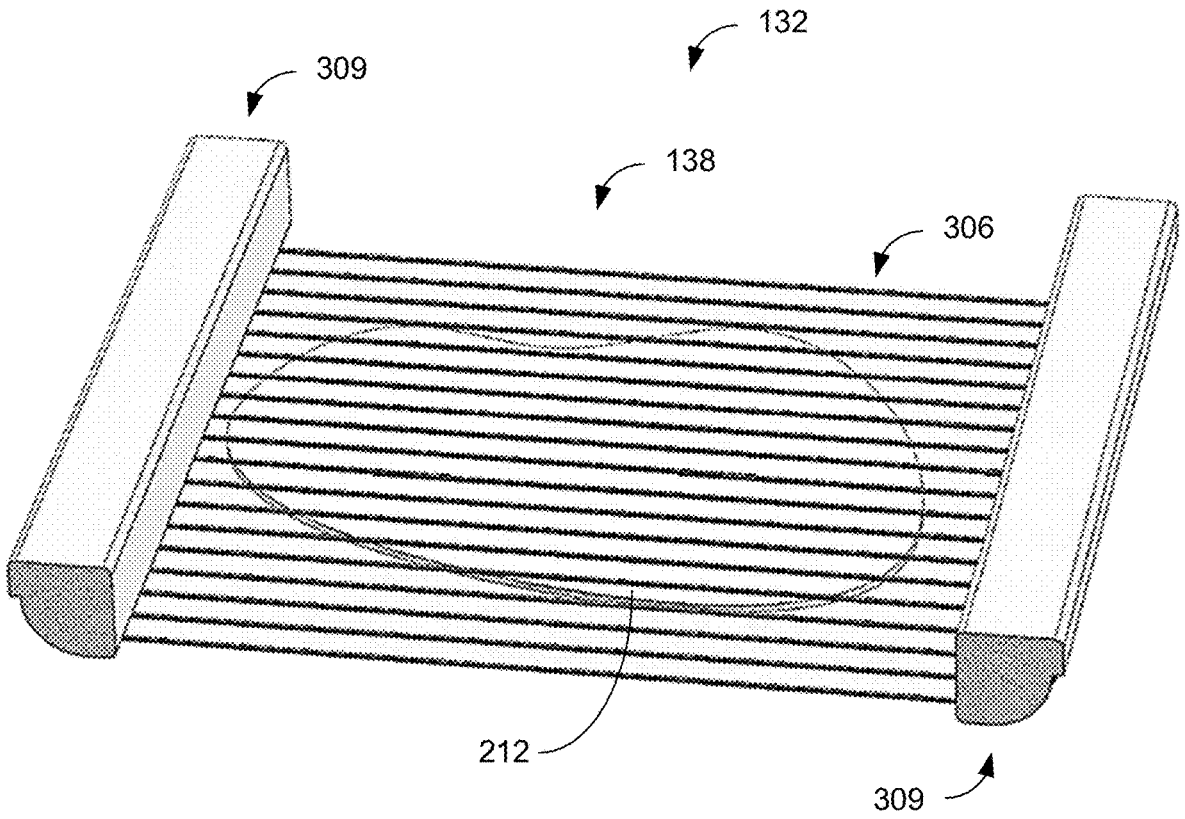
FIGS. 3A and 3B illustrate an example of securing cables that can be included in a material holding apparatus, according to various embodiments of the present disclosure.
Figure 3B:
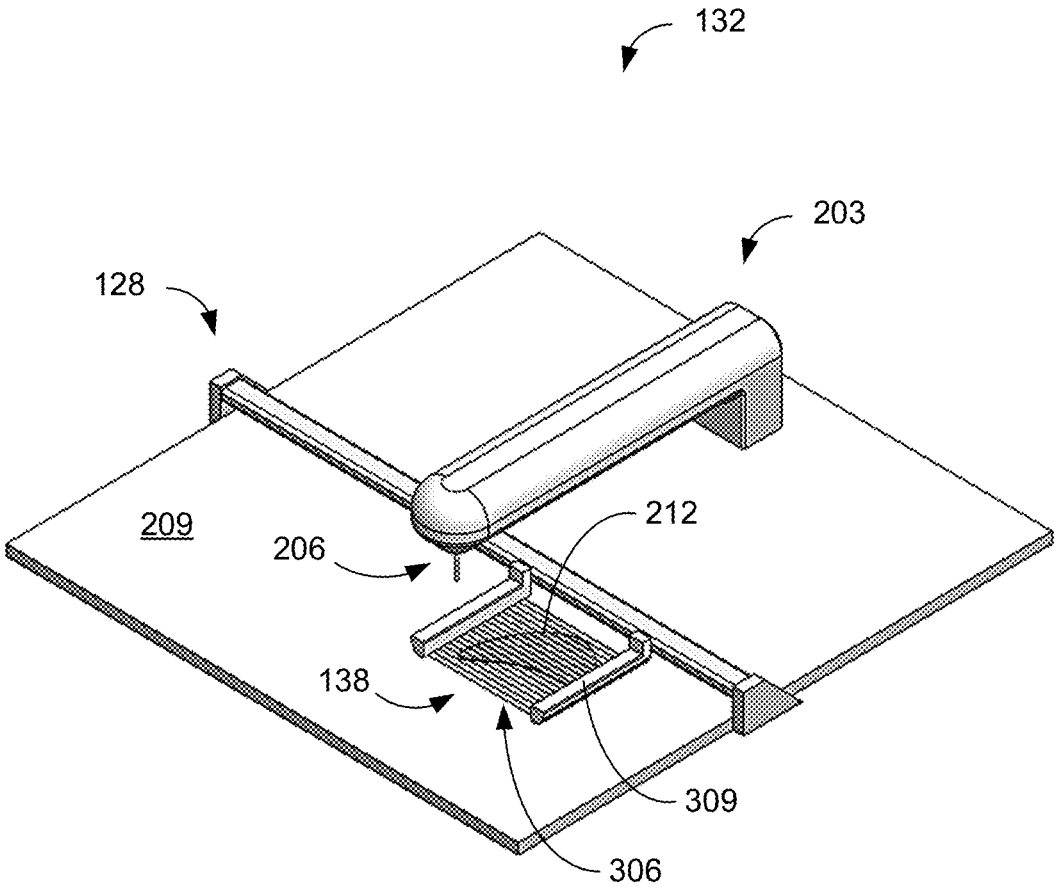

In some embodiments, the material holding apparatus 132 can comprise securing cables 138 (FIG. 1), an example of which is illustrated in FIGS. 3A and 3B. Functioning of the securing cables will now be disclosed with reference to FIG. 3A. One skilled in the art will appreciate that, for this and other processes and methods disclosed herein, the functions performed in the processes and methods may be implemented in differing order. Furthermore, the outlined operations are only provided as examples, and some of the operations may be optional, combined into fewer operations, or expanded into additional operations without detracting from the essence of the disclosed embodiments.

As illustrated in FIG. 3A, the securing cables 138 can comprise a grid of thin cables 306 attached between cable supports 309, where the array of cables 306 can be positioned to spread across and press down onto the material(s) 212. This cable grid 306 is attached to the translation system 128 of an automated sewing machine 122. The downward force applied by the array of cables 306 allows the translation system 128 to move the material(s) 212 with respect to the sewing machine 203. The cables 306 can be made from a material that, when struck by the sewing needle 206, will shift instead of being penetrated or damaging the sewing needle 206. The cables can also be formed such that they do not cause defects in the seam when sewn over. An example of such a defect is loose sewing thread due to the cables 306 being too large. The cables 306 can be made of monofilament nylon or solid steel wire, for example. The automated sewing machine 122 is thus able to sew an arbitrary shaped seam across the surface of the material(s) 212 without the material holding apparatus 132 interfering with the sewing mechanisms. After sewing, the cables 306 can be disconnected from one side of the material holding apparatus 132 (or cable support 309), and pulled out of the seams, freeing the material(s) 212.

As illustrated in FIG. 3B, the securing cables 138 can be attached to the translation system 128 of an automated sewing machine 122. The translation system 128 can cause the securing cables 138 to exert a downwards force on the material(s) 212. The applied downward force allows the translation system 128 to move the material(s) 212 with respect to the sewing machine 203. The sewing needle 206 is positioned over the securing cables 138 for sewing the material(s) 212 by the automated sewing machine 122. After sewing the securing cables 138 can be removed. The automated sewing machine can thus sew an arbitrary shaped seam across much of the surface of the material(s) 212 without the material holding apparatus 132 interfering with the sewing mechanisms.

Figure 4:
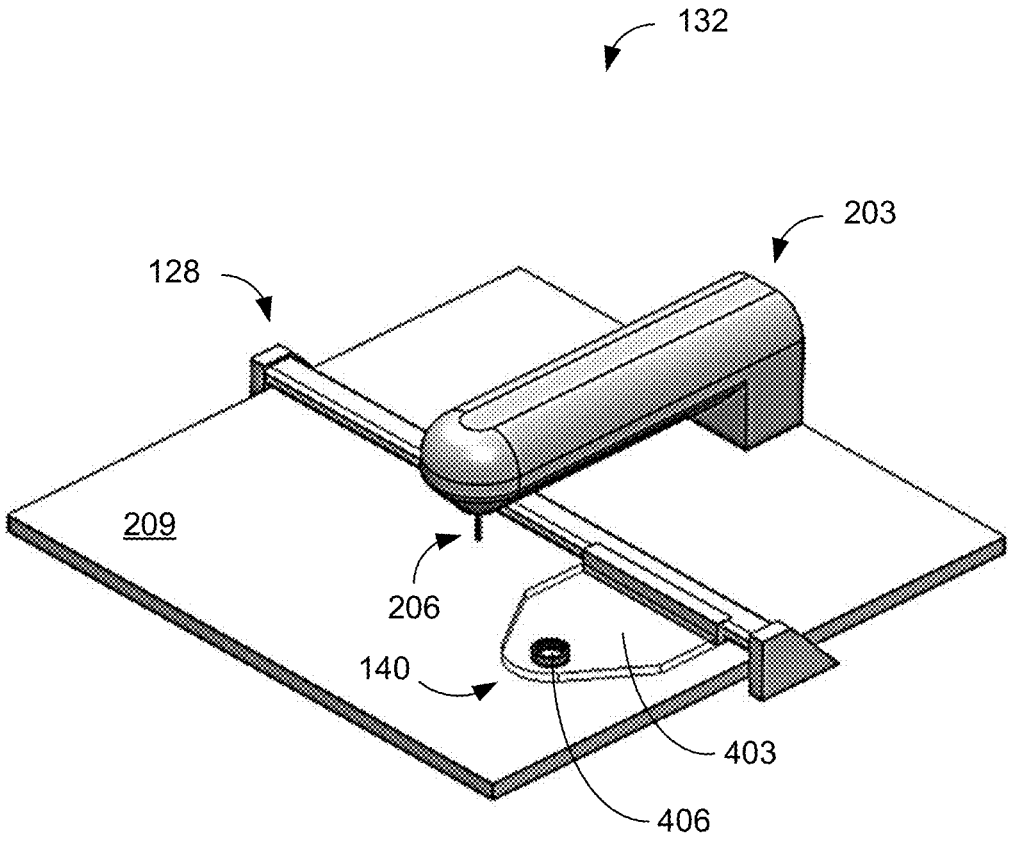
FIG. 4 illustrates an example of a sewing window that can be included in a material holding apparatus, according to various embodiments of the present disclosure.

In some embodiments, the material holding apparatus 132 can comprise a sewing window 140, an example of which is illustrated in FIG. 4. Functioning of the sewing window will now be disclosed with reference to FIG. 4. One skilled in the art will appreciate that, for this and other processes and methods disclosed herein, the functions performed in the processes and methods may be implemented in differing order. Furthermore, the outlined operations are only provided as examples, and some of the operations may be optional, combined into fewer operations, or expanded into additional operations without detracting from the essence of the disclosed embodiments.

As illustrated in FIG. 4, the sewing window 140 can comprise a plate 403 with a circular opening 406. The opening can comprise other shapes such as geometric shapes (e.g., square, rectangular, hexagonal, octagonal, etc.). The plate 403 is attached to the translation system 128 of an automated sewing machine 122. The translation system 128 can cause the plate 403 to exert a downwards force on the material(s) 212 (not shown in FIG. 4). The applied downward force allows the translation system 128 to move the material(s) 212 with respect to the sewing machine 203. The sewing needle 206 is positioned over the opening 406, and the automated sewing machine 122 sews the material(s) 212 until the needle reaches the edge of the opening 406. The plate 403 is then lifted and repositioned on the material(s) 212, allowing more of the seam to be sewn. This process can be repeated until the sewing process is complete. The automated sewing machine can thus sew an arbitrary shaped seam across much of the surface of the material(s) 212 without the material holding apparatus 132 interfering with the sewing mechanisms.

Figure 5:
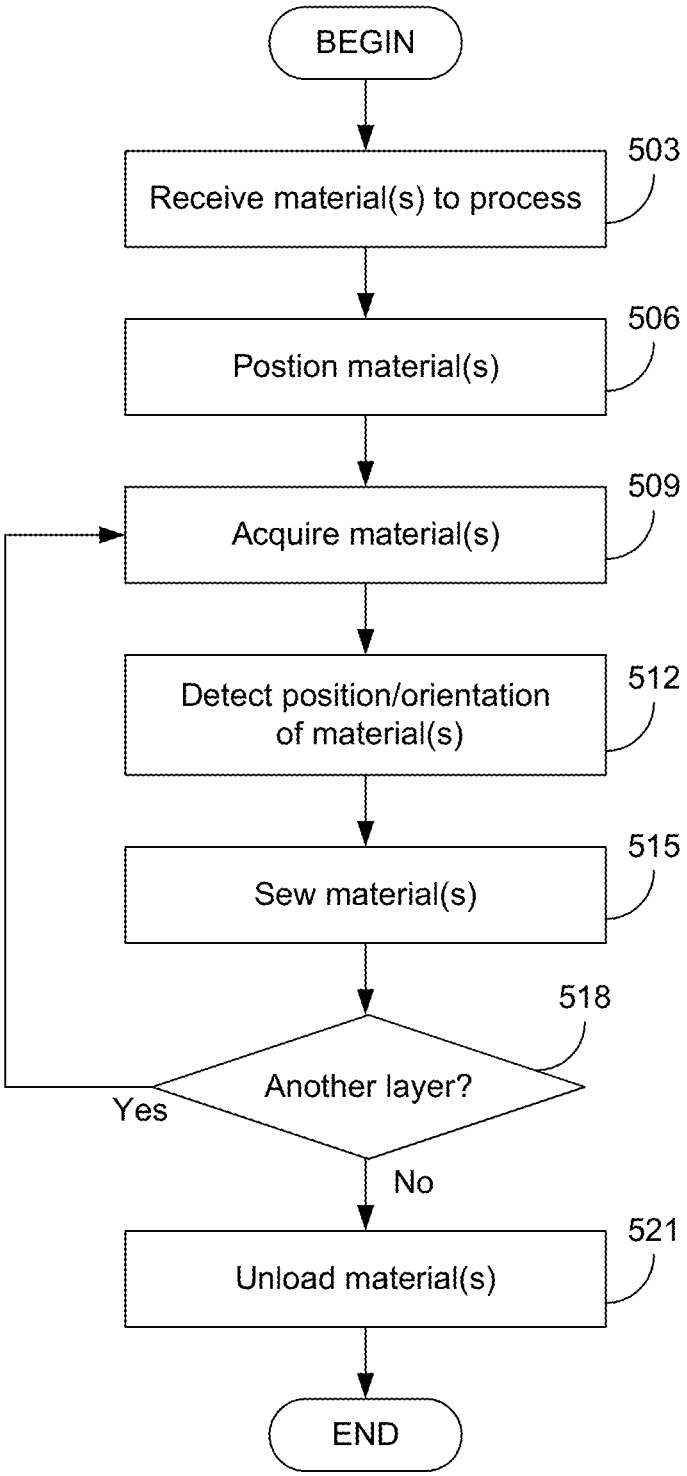
FIG. 5 is a flow chart illustrating an example of a method for palletless sewing, according to various embodiments of the present disclosure.

Referring to FIG. 5, shown is an example of a palletless sewing method in accordance with various aspects of the present disclosure. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Beginning at 503, material(s) 212 are received by the robotic system 102 (e.g., a sewing robot) for processing by the automated sewing machine 122. For example, the one or more materials can be provided to a secondary operation device 116 such as, e.g., a destacker of the robotic system 102, which can separate a top piece of material from a stack of material. At 506, the material(s) 212 can be positioned and oriented for sewing by the automated sewing machine 122. The material(s) can be placed in designated preparation areas and/or at specified orientations in a work area to facilitate sewing of the material(s) 212. For example, the destacker can be used to move a piece of material 212 to an initial location of the work area. In some embodiments, material mover(s) 114 such as industrial robots with end effectors can provide pieces of material 212 in desired locations and orientations for further processing by the automated sewing machine 122.

Next, the material(s) 212 can be acquired at 509 for sewing by the automated sewing machine 122. Sensing devices 120 can be used to detect the position and current orientation of a piece of material 212 in the work area at 512.

The sensor devices 120 can capture data, for example a camera capturing a series of images, of one or more pieces of material on the work area. The captured sensor data can be compared to pattern data, e.g., in a pattern database of the operation control(s) 126. In one embodiment, the series of images can be captured with a camera and compared to pattern information (e.g., a size model, a curve model, an irregularities model, etc.) to identify the piece of material 212. Based on the identification, the piece(s) of material 212 can be stacked, positioned and/or oriented on the sewing plane 209 for sewing by the automated sewing machine 122. For example, an industrial robot can pick up a piece of material 212 using an end effector and position and/or orient the piece of material 212 on the sewing plane 209 for sewing. Another piece of material 212 can be picked up and aligned on top of the first piece of material 212 by the industrial robot for sewing. Multiple pieces of material 212 can be stacked on the sewing plane 209 in this fashion for sewing by the automated sewing machine 122. An alignment module of the operational control(s) 126 can be used to control the positioning, orientation and/or stacking of layers of material 212 on the sewing plane 209.

The acquired material(s) 212 can then be secured by the material holding apparatus 132 and repositioned using the translation system 128 for sewing at 515 with the sewing needle 206 of the sewing machine 203. The material(s) 212 can sewn while the material holding apparatus 132 holds it in position and orientation. The translation system 128 can reposition and/or orient the material(s) 212 via the material holding apparatus 132 while sewing along a controlled path. As described, the material holding apparatus 132 can comprise mechanical fingers 134 configured to linearly reposition to provide clearance around the sewing needle 206 while maintaining position and orientation of the layered materials 212. In some embodiments, the material holding apparatus 132 can comprise securing cables 138 that can be positioned across the material(s) 212. The material(s) 212 can be sewn over the securing cables 138. In other embodiments, the material holding apparatus 132 can comprise a sewing window 140 that can be positioned across the material(s) 212. The material(s) 212 can be sewn through the sewing window 140. The sewing process can be stopped and the sewing window 140 can be repositioned by the translation system 128 in order to continue sewing along the specified path.

When the seam is completed at 515, then it can be determined at 518 if another layer (or layers) of material 212 is to be added to the sewn material 212. If so, then the flow can return to 509 where one or more additional layer(s) of material 212 can be acquired and aligned with the sewn material for further sewing by the automated sewing machine 122. For example, the translation system 128 can position and/or orient a sewn stack of layered materials 212 on the sewing plane 209 to allow the industrial robot to pick up another piece of material 212 and aligned on top of the layered materials 212 for sewing. The added layers can then be sewn at 515 using the material holding apparatus 132 as previously discussed. This can be repeated until all layers of material 212 have been processed by the automated sewing machine 122.

If the sewing process has been completed and no additional layers of material 212 are to be added, then the finished product is unloaded from the sewing plane 209 at 521. For example, the translation system 128 can move the finished product using the material holding apparatus 132 to a position that allows it to be removed from the sewing plane 209 using, e.g., an industrial robot with an end effector.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A method for palletless sewing of material, comprising:

positioning a second piece of material on a first piece of material located on a sewing plane;

positioning a material holding apparatus over the second and first pieces of material, the material holding apparatus securing position and orientation of the second piece of material with respect to the first piece of material;

locating the second and first pieces of material under a sewing needle of an automated sewing machine by repositioning the material holding apparatus; and sewing the second piece of material to the first piece of material along a controlled path across the material holding apparatus, wherein the material holding apparatus is configured to allow sewing an arbitrary shaped seam.

2. The method of claim 1, wherein the material holding apparatus moves the second and first pieces of material on the sewing plane to facilitate sewing of the second piece of material to the first piece of material based upon the controlled path.

3. The method of claim 2, wherein the material holding apparatus is repositioned by a translation system comprising controlled actuators.

4. A method for palletless sewing of material, comprising:

positioning a second piece of material on a first piece of material located on a sewing plane;

positioning a material holding apparatus over the second and first pieces of material, the material holding apparatus comprising mechanical fingers that contact the second and first pieces of material on the sewing plane, the mechanical fingers securing position and orientation of the second piece of material with respect to the first piece of material, wherein each of the mechanical fingers comprises a belt that contacts the material to secure the orientation and position, the belt configured to rotate to maintain contact with the material during a linear translation of the mechanical fingers;

locating the second and first pieces of material under a sewing needle of an automated sewing machine by repositioning the material holding apparatus; and sewing the second piece of material to the first piece of material.

5. The method of claim 4, wherein the mechanical fingers are translated to provide clearance about the sewing needle.

6. The method of claim 4, wherein the material holding apparatus comprises a cam profile attached to the automated sewing machine, the cam profile positioned to engage with one or more followers of the mechanical fingers.

7. The method of claim 6, wherein each of the mechanical fingers comprises a follower.

8. The method of claim 7, wherein a tensioning device attached to the mechanical finger maintains contact of the follower with a surface of the cam profile.

9. The method of claim 6, wherein the surface of the cam profile comprises a projecting portion, where the mechanical fingers linearly translate away from the sewing needle in response to engagement with the projection portion.

10. The method of claim 6, wherein the followers of the mechanical fingers move across the surface of the cam profile in response to repositioning of the mechanical fingers by a translation system.

11. A method for palletless sewing of material, comprising:

positioning a second piece of material on a first piece of material located on a sewing plane;

positioning a material holding apparatus over the second and first pieces of material, wherein the material holding apparatus comprises securing cables that contact the second and first pieces of material on the sewing plane, the securing cables securing the position and orientation of the second piece of material with respect to the first piece of material;

locating the second and first pieces of material under a sewing needle of an automated sewing machine by repositioning the material holding apparatus; and sewing the second piece of material to the first piece of material.

12. The method of claim 11, wherein the securing cables is a grid of securing cables attached between cable supports, wherein the grid of securing cables spread across and press down onto the second and first pieces of material.

13. The method of claim 12, wherein the second piece of material is sewn to the first piece of material based upon a predefined path through the securing cables.

14. The method of claim 13, comprising disconnecting the securing cables from one of the cable supports and removing the cables from the sewn stitches.

15. The method of claim 1, wherein the material holding apparatus comprises a sewing window that contacts the second and first pieces of material on the sewing plane, the sewing window securing the position and orientation of the second piece of material with respect to the first piece of material.

16. The method of claim 15, wherein the sewing window comprises a plate comprising an opening providing access for sewing, wherein the plate exerts a downwards force onto the second and first pieces of material and the second piece of material is sewn to the first piece of material based upon the controlled path through the opening.

17. The method of claim 16, wherein the opening is a circular window.

18. The method of claim 16, wherein the plate is attached to a translation system.

19. The method of claim 16, wherein the controlled path is a predefined path, and sewing the second piece of material to the first piece of material comprises:

sewing the second piece of material to the first piece of material through the opening based upon a first portion of the predefined path;

repositioning the sewing window on the second and first pieces of material, the opening providing access for sewing a second portion of the predefined path; and sewing the second piece of material to the first piece of material through the opening based upon the second portion of the predefined path.

20. The method of claim 11, wherein the material holding apparatus moves the second and first pieces of material on the sewing plane to facilitate sewing of the second piece of material to the first piece of material based upon a predefined path.

* * * * *